US007878257B2

(12) United States Patent
Chen et al.

(10) Patent No.: US 7,878,257 B2
(45) Date of Patent: Feb. 1, 2011

(54) TRIGGERING MECHANISM DISCRIMINATED BY LENGTH DIFFERENCE

(75) Inventors: Kuo-Chiang Chen, Sugar Land, TX (US); Gary Rytlewski, League City, TX (US); John Fleming, Damon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 123 days.

(21) Appl. No.: 12/390,822

(22) Filed: Feb. 23, 2009

(65) Prior Publication Data

US 2010/0212911 A1 Aug. 26, 2010

(51) Int. Cl.
*E21B 34/10* (2006.01)

(52) U.S. Cl. ..... 166/386; 166/318; 166/332.4

(58) Field of Classification Search ..... 166/386, 166/318, 332.4
See application file for complete search history.

(56) References Cited

U.S. PATENT DOCUMENTS 3,452,815 A 7/1969 Watkins
4,614,233 A 9/1986 Menard
6,102,126 A 8/2000 Huber
6,354,374 B1 3/2002 Edwards
6,719,061 B2 4/2004 Muller
7,128,152 B2 10/2006 Anyan
7,397,388 B2 7/2008 Huang
7,455,114 B2 11/2008 MacDougall
2004/0251684 A1 12/2004 Dyck
2007/0181224 A1 8/2007 Marya
2008/0110615 A1* 5/2008 Xu ..... 166/153
2008/0142225 A1 6/2008 Prado
2010/0051284 A1* 3/2010 Stewart ..... 166/325

* cited by examiner

*Primary Examiner*—William P Neuder
(74) *Attorney, Agent, or Firm*—Rodney Warfford

(57) ABSTRACT

A downhole trigger mechanism and method for using the same are provided. The downhole trigger mechanism can include at least two contact points spaced a longitudinal distance from one another. The trigger mechanism can be actuated when the contact points of the trigger mechanism are simultaneously contacted by at least two contact points of an actuator. The contact points of the actuator can be spaced a longitudinal distance from one another.

19 Claims, 8 Drawing Sheets

TRIGGERING MECHANISM DISCRIMINATED BY LENGTH DIFFERENCE

BACKGROUND

Downhole valve assemblies can be used to selectively treat and/or produce wellbores. In treat and produce operations ("TAP"), for example, downhole valves are placed in a casing string and the wellbore is completed with normal cementing operations. The downhole valves are typically opened one at a time to selectively fracture hydrocarbon producing zones or formations within the wellbore. Consequently, TAP operations can be performed without a perforation treatment.

One way to actuate the downhole valves is to use a "ball" in combination with a restriction to provide a go/no-go triggering mechanism. When the outer diameter of the ball is smaller than the restriction in the valve, the ball can pass through the valve and the valve will remain in a closed position. When the outer diameter of the ball is larger than the restriction in the valve, the ball is stopped by the restriction in the valve actuating the valve. However, the use of a ball in combination with a restriction in the valve can be problematic because the number of downhole valves that can be used is limited by the diameter of the wellbore.

Another way to actuate the downhole valves is to use a control line. Generally, the control line can pressurize a piston in a sliding sleeve valve. The piston can squeeze a c-ring within the sliding sleeve valve and can reduce the inside diameter of the c-ring. When the c-ring has a reduced diameter, the c-ring can catch a downhole dart. Pressure can be applied to the dart causing the dart to longitudinally move the sliding sleeve. This method can be repeated for each valve disposed downhole. However, using a control line to actuate a downhole valve can be problematic because the control line can become damaged. A damaged control line can prevent actuation of the downhole valves.

There is a need, therefore, for a downhole valve triggering mechanism that is not limited by the diameter of the wellbore and that does not require a control line.

SUMMARY

Apparatus and methods for actuating a downhole valve are provided. In at least one specific embodiment, the apparatus can include at least two contact points spaced a longitudinal distance from one another. When at least two contact points of the apparatus are contacted by two longitudinally spaced contact points on an actuator, the apparatus can be actuated. The actuated apparatus can facilitate the actuation of a downhole valve.

In at least one specific embodiment, the method can include engaging the apparatus with an actuator that has at least two contact points spaced a longitudinal distance from one another. The engagement of the actuator and the apparatus can occur at least partially within a sliding sleeve. The method can further include actuating the trigger mechanism by simultaneously contacting the two contact points of the trigger mechanism with the two contact points of the actuator.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
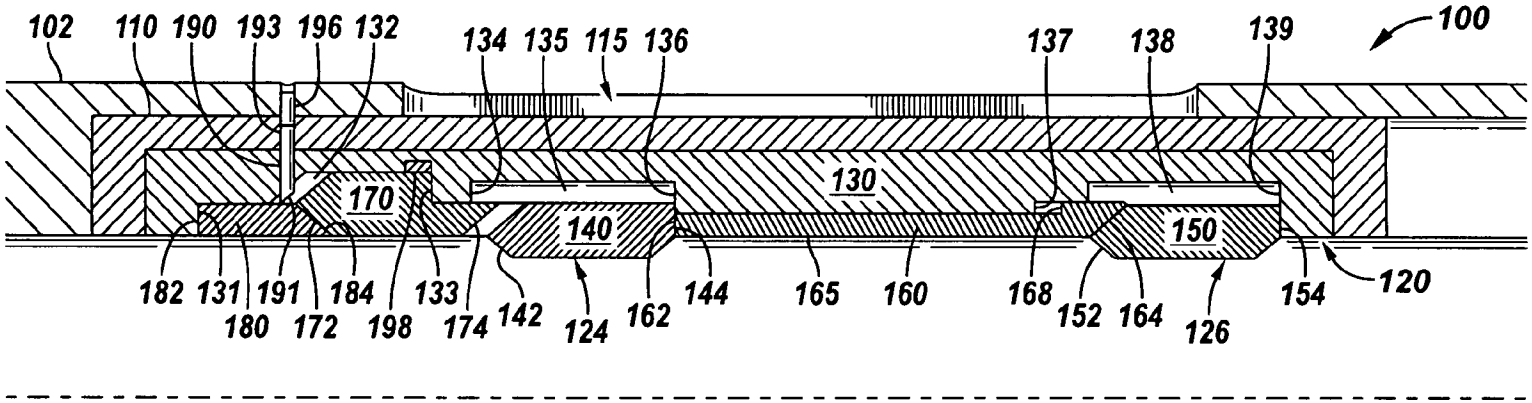
FIG. 1 depicts a cross-section view of an illustrative downhole valve assembly with an integrated trigger mechanism, according to one or more embodiments described.

FIG. 1 depicts a cross-section view of an illustrative downhole valve assembly 100 with an integrated trigger mechanism 120, according to one or more embodiments. The downhole valve assembly 100 can be configured to perform TAP, gravel packing, or any other downhole operation that requires activation of a downhole valve. The downhole valve assembly 100 can have at least one trigger mechanism 120 at least partially disposed within a sliding sleeve 110. The sliding sleeve 110 can be at least partially disposed within a housing 102 having one or more flow ports 115 formed therethrough. The sliding sleeve 110 can be configured to selectively open the one or more flow ports 115 in the housing 102 to provide a flow path through the valve assembly 100. For example, the sliding sleeve 110 can be moved from a first or "closed" position to a second or "open" position.

The trigger mechanism 120 facilitates the movement of the sliding sleeve 110 so that the valve assembly 100 can be opened and closed. The trigger mechanism 120 can have a housing 130 with three or more recesses 132, 135, 138 formed in an inner surface thereof. One or more members 140, 150, 160, 170, 180 can be selectively moved within the recesses 132, 135, 138 and/or the housing 102 to actuate the trigger mechanism 120. In one or more embodiments, the first member 140 and the second member 150 can be selectively moved radially outward or radially expanded by an external outward force. As used herein, "radial" is the direction perpendicular to a centerline of the wellbore. When the members 140, 150 are expanded the actuation of the trigger mechanism 120 can be initiated. When the actuation of the trigger mechanism 120 is initiated, the second member 150 can longitudinally move the third member 160. As used herein, "longitudinal" is the direction along the centerline of the wellbore. The third member 160 can longitudinally move the radially expanded first member 140, and the radially expanded first member 140 can longitudinally move the fourth member 170. When the fourth member 170 is longitudinally moved, the fourth member 170 can move the fifth member 180 radially inward or radially compress the fifth member 180. When the fifth member 180 is radially compressed, the trigger mechanism 120 can be said to be actuated. The actuated trigger mechanism 120 can catch a downhole instrument to facilitate the movement of the sliding sleeve 110. The interaction between the members 140, 150, 160, 170, 180 is discussed in more detail below. The movement of the members 140, 150, 160, 170, 180 can be controlled by the recesses 132, 135, 138.

In one or more embodiments, the first recess 132 can have a first wall 131 and a second wall 133. The first wall 131 and the second wall 133 can control the movement and/or constrain the fifth member 180 and the fourth member 170. The second recess 135 can have a first wall 134 and a second wall 136. The walls 134, 136 can constrain and/or control the movement of the fourth member 170 and the first member 140. The third recess 138 can have a first wall 137 and a second wall 139. The first wall 137 and the second wall 139 can constrain and/or control the movement of the third member 160 and the second member 150.

The first member 140 can be a ring or sleeve configured to be radially adjustable. The first member 140 can be a ring or sleeve configured to be radially expanded. In one or more embodiments, the first member 140 can be a split ring. The first member 140 can have a first end 142 adjacent the fourth member 170 and a second end 144 adjacent the third member 160. The second member 150 can be disposed within the third recess 138. The second member 150 can be a ring or sleeve configured to be radially expanded. In one or more embodiments, the second member 150 can be a split ring. The second member 150 can have a first end 152 and a second end 154. The first end 152 can be adjacent the third member 160. The second end 154 can be adjacent the second wall 139. In one or more embodiments, at least a portion of the second end 154 can be parallel to or adapted to sit flush with the second wall 139. The first end 152 and the second end 154 can be sloped to control the movement of the second member 150 and the interaction of the second member 150 with the third member 160.

The third member 160 can be disposed between the second end 144 of the first member 140 and the first end 152 of the second member 150. The third member 160 can have a body 165 disposed between a first end 162 and a second end 164. A shoulder 168 can be formed between the second end 164 and the body 165. The shoulder 168 can engage a mating surface formed on the first wall 137 of the third recess 138. The interaction between the shoulder 168 and the first wall 137 can limit the longitudinal travel of the third member 160. The second end 164, the body 165, and the first end 162 can have an unibody configuration or the second end 164, the body 165, and the first end 162 can include several parts integrally joined together, for example by threaded connections. The ends 162, 164 can be sloped and/or straight to control the interaction of the third member 160 with the first member 140 and the second member 150 respectively.

The fourth member 170 can be disposed between the second end 184 of the fifth member 180 and the first end 142 of the first member 140. The fourth member 170 can be a ring or tubular. The fourth member 170 can have a v-shaped first end 172, which is adjacent the fifth member 180. The fourth member 170 can also have a second end 174 adjacent the first member 140. The fourth member 170 can longitudinally move from a first position to a second position within the housing 130, when the second end 174 is contacted by a radially expanded first member 140. In the second position, the fourth member 170 can radially compress the fifth member 180. Consequently, the inner surface of the first end 172 can be aligned with an outer surface of the second end 184 of the fifth member 180. For example, the first end 172 can overlay or sit on a second end 184.

The fifth member 180 can be at least partially disposed between the first wall 131 and the second wall 133 of the first recess 132. The fifth member 180 can have a first end 182 disposed adjacent the first wall 131 and the second end 184 adjacent the fourth member 170. The fifth member 180 can be a ring or sleeve configured to be radially adjustable. In one or more embodiments, the fifth member 180 can be a c-ring or split-ring. Accordingly, the fifth member 180 can be configured to be radially compressed. When the fifth member 180 is radially compressed, the fifth member 180 can catch a dart flowing through the downhole valve assembly 100.

The trigger mechanism 120 can further include a first pin 190. The first pin 190 can have a cylindrical shape or any other shape. The first pin 190 can have a first end 191 at least partially disposed within the housing 130 of the trigger mechanism 120, and the first pin 190 can radially extend out of the housing 130 adjacent the fifth member 180. The first end 191 can have a slope that corresponds to or complements a slope of the outer surface of the first end 172 of the fourth member 170. The first pin 190 can have a second end 193 at least partially disposed within the sliding sleeve 110. Accordingly, the first pin 190 can secure the trigger mechanism 120 to the sliding sleeve 110.

The second end 193 of the first pin 190 can be aligned with or adjacent a second pin 196. The second pin 196 can be cylindrical in shape or any other shape. The second pin 196 can be at least partially disposed between the valve housing 102 and the sliding sleeve 110. As such, the second pin 196 can releasably secure the housing 102 to the sliding sleeve 110.

A locking member 198 can be disposed between the fourth member 170 and the housing 130. The locking member 198 can be a ring or tubular. For example, the locking member 198 can be a snap ring or any other shape retaining device. The locking member 198 can be compressed or in a deformed shape when the fourth member 170 is in the first position. The locking member 198 can be in an extended or in an original shape when the fourth member 170 is in the second position. Accordingly, the locking member 198 can prevent movement of the fourth member 170 from the second position to the first position, as explained in more detail below.

The port 115 can allow fluid communication between the inner bore of the valve housing 102 to the external diameter of the valve housing 102. The port 115 can be selectively opened or closed by the sliding sleeve 110. For example, the sliding sleeve 110 can be selectively moved from the first position to the second position within the valve housing 102. When the sliding sleeve 110 is in the first position, the sliding sleeve 110 prevents flow through the port 115. When the sliding sleeve 110 is in the second position, the sliding sleeve 110 allows fluid flow through the flow port 115. Consequently, the sliding sleeve 110 prevents communication between the inner bore of the valve housing 102 and the outer diameter of the valve housing 102, when in the first position. The sliding sleeve 110 allows communication between the inner bore of the valve housing 102 and the outer diameter of the valve housing 102, when in the second position.

The trigger mechanism 120 can be actuated as described below when two contact points 124, 126 are contacted simultaneously by an actuator, such as the actuator described in FIG. 2. In one or more embodiments, the first member 140 can include or be the first contact point 124. For example, the first contact point 124 can be a portion of the inner surface of the first member 140. Furthermore, the second member 150 can be or include the second contact point 126. For example, the second contact point 126 can be an inner portion of the second member 150.

Figure 2:
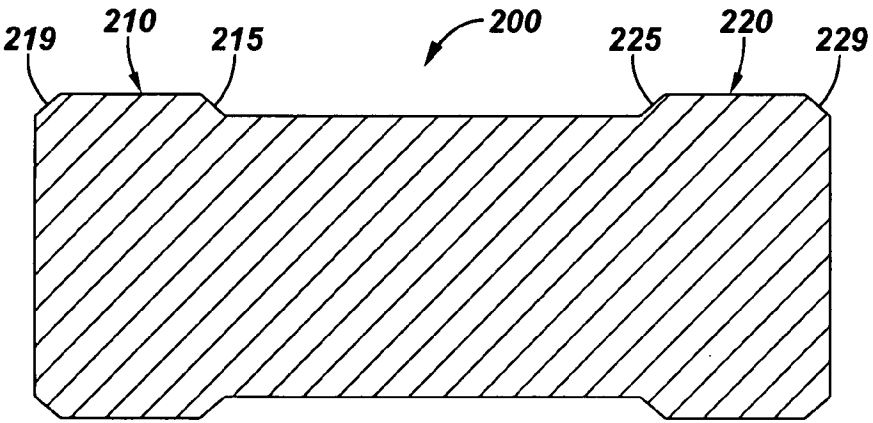
FIG. 2 depicts a cross-section view an illustrative actuator, according to one or more embodiments described.

Considering the actuator 200 in more detail, FIG. 2 depicts an illustrative actuator 200, according to one or more embodiments. The actuator 200 can be any instrument that can longitudinally flow within a bore of a tubular, such as a dart. The actuator 200 can have a first contact point 210 and a second contact point 220 spaced a longitudinally distance from one another. The first contact point 210 and second contact point 220 can have inner edges 215, 225 and outer edges 219, 229. The outer diameters of the first contact point 210 and the second contact point 220 can be large enough to contact at least a portion of the contact points 124, 126 of the trigger mechanism 120, and a portion of the actuator 200 can be such that the actuator 200 only contacts the contact points 124, 126 with the contact points 210, 220.

Accordingly, the trigger mechanism 120 can act as an And-gate, i.e. can require two positive inputs for one positive output. Consequently, the two positive inputs can be "simultaneous" engagement or contact of the two contact points 124, 126 of the trigger mechanism 120 with the two contact points 210, 220 of the actuator 200; the positive output can be the actuation of the trigger mechanism 120, such as radial compression of the fifth member 180. Simultaneous engagement can mean that at least a portion of the first contact point 124 and at least a portion of the second contact point 126 of the trigger mechanism 120 are in contact with at least a portion of the first contact point 210 and at least a portion of the second contact point 220 of the actuator 200 at the same time.

Figure 3:
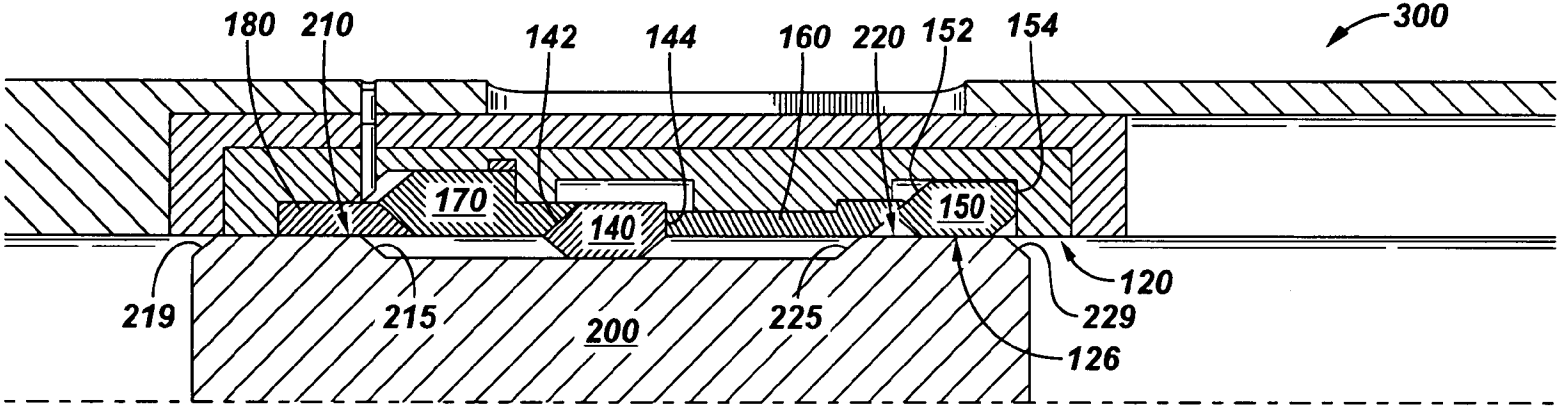
FIGS. 3-4 depict a cross-section view of an illustrative actuator passing through a first downhole valve assembly without actuating the trigger mechanism, according to one or more embodiments described.
Figure 4:
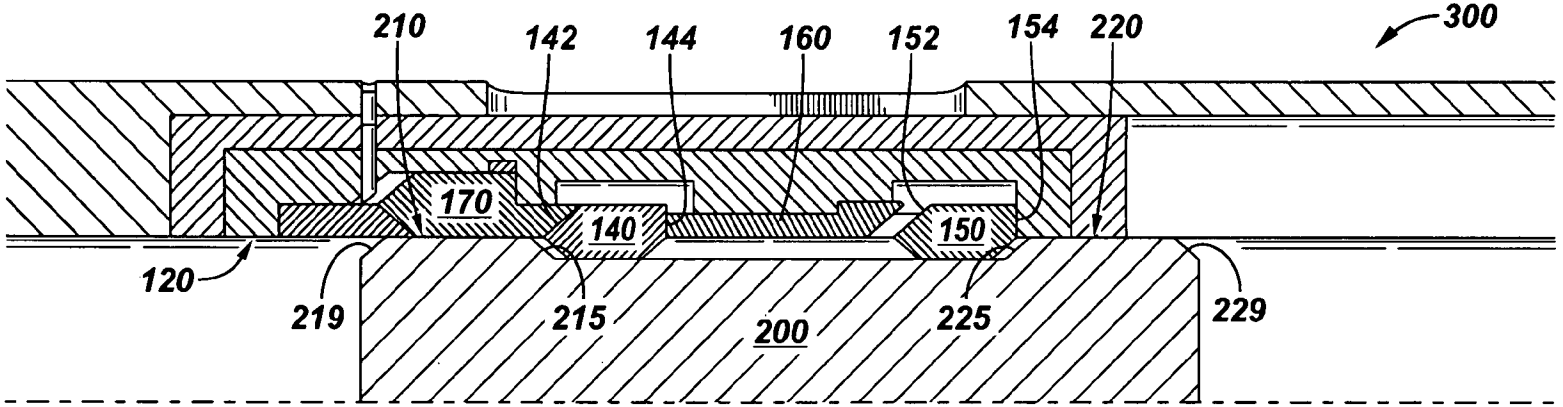
Figure 5:
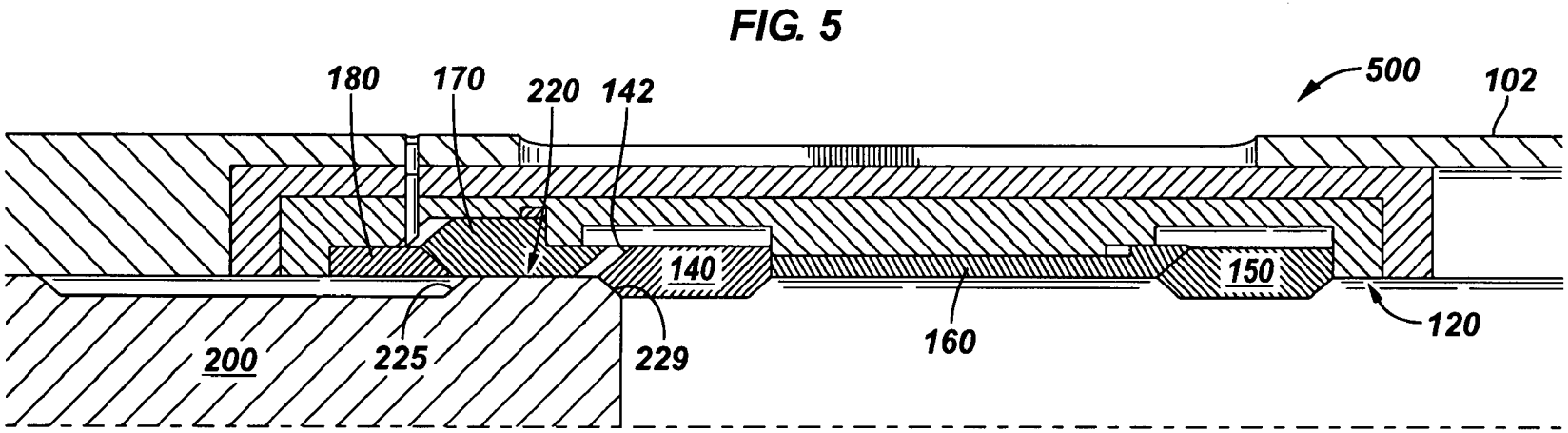
FIGS. 5-11 depict a cross-section view of the illustrative actuator of FIGS. 3-4 passing through an illustrative second downhole valve assembly and actuating a trigger mechanism, according to one or more embodiments described.

FIGS. 3-4 depict a cross-section view of an illustrative actuator 200 passing through a first downhole valve assembly 300 without actuating the trigger mechanism 120, according to one or more embodiments. The first downhole valve assembly 300 can be similar or substantially similar to the illustrative downhole valve assembly 100 of FIG. 1. The actuator 200 can be configured to pass through the first downhole valve assembly 300 without actuating the trigger mechanism 120. For example, when the longitudinal distance between the outer edges 219, 229 of the contact points 210, 220 is shorter than the longitudinal distance between the second end 144 of the first member 140 and the first end 152 of the second member 150, the actuator 200 can pass through the first downhole valve assembly 300 with out actuating the trigger mechanism 120. In one or more embodiments, when the longitudinal distance between the inner edges 215, 225 of the contact points 210, 220 is longer than the longitudinal distance between the first end 142 of the first member 140 and the second end 154 of the second member 150, the actuator 200 can pass through the first downhole valve assembly 300 without actuating the trigger mechanism 120. In either of the above described situations, the first member 140 and the second member 150 will not be radially expanded or contacted at the same time, and the actuator 200 can pass through the first downhole valve assembly 300 without actuating the trigger mechanism 120.

In FIG. 3 the second contact point 220 of the actuator 200 is depicted engaged with the second contact point 126. The second member 150 can be radially expanded due to the external radially outward force applied thereto by the second contact point 220. The first member 140 can be in a radially unexpanded state because the outer diameter of the actuator 200 between the contact points 210, 220 is smaller than the inner diameter of the first member 140. The third member 160 can be moved longitudinally by the second member 150 and can even contact or engage the first member 140; however, since the first member 140 is not radially expanded the first member 140 can not move the fourth member 170 to the second position, if at all, to fully radially compress the fifth member 180.

In FIG. 4 the actuator 200 is depicted further downhole. The second contact point 220 is depicted exiting the first downhole valve assembly 300. As depicted in FIG. 4, the first member 140 and second member 150 can not be simultaneously or near simultaneously radially expanded by the contact points 210, 220 of the actuator 200 because the longitudinal distance between the inner edges 215, 225 of the contact points 210, 220 is longer than the longitudinal distance between the first end 142 of the first member 140 and the second end 154 of the second member 150. Accordingly, the first member 140 and second member 150 can not be radially expanded simultaneously, and the trigger mechanism 120 will not be actuated. Consequently, the actuator 200 can exit the first downhole valve assembly 300, and the trigger mechanism 120 of the first downhole valve assembly 300 can remain in an original or deactivated state. The actuator 200 can flow downhole and actuate a trigger mechanism 120, as depicted in FIGS. 5-11.

As used herein, the terms "up" and "down"; "upper" and "lower"; "upwardly" and "downwardly"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

FIGS. 5-11 depict a cross-section view of the illustrative actuator 200 of FIGS. 3-4 passing through an illustrative second downhole valve assembly 500 and actuating a trigger mechanism 120, according to one or more embodiments. The actuator 200 can flow through the first downhole valve assembly 300, as described above, and enter a second downhole valve assembly 500. The second downhole valve assembly 500 can be down stream of the first downhole valve assembly 300. The second downhole valve assembly 500 can be similar to the first downhole valve assembly 300. The actuator 200 can partially enter the inner diameter of the valve housing 102 of the second downhole valve assembly 500. The second contact point 220 can pass through the fifth member 180 and the fourth member 170, and can engage the first end 142 of the first member 140.

Figure 6:
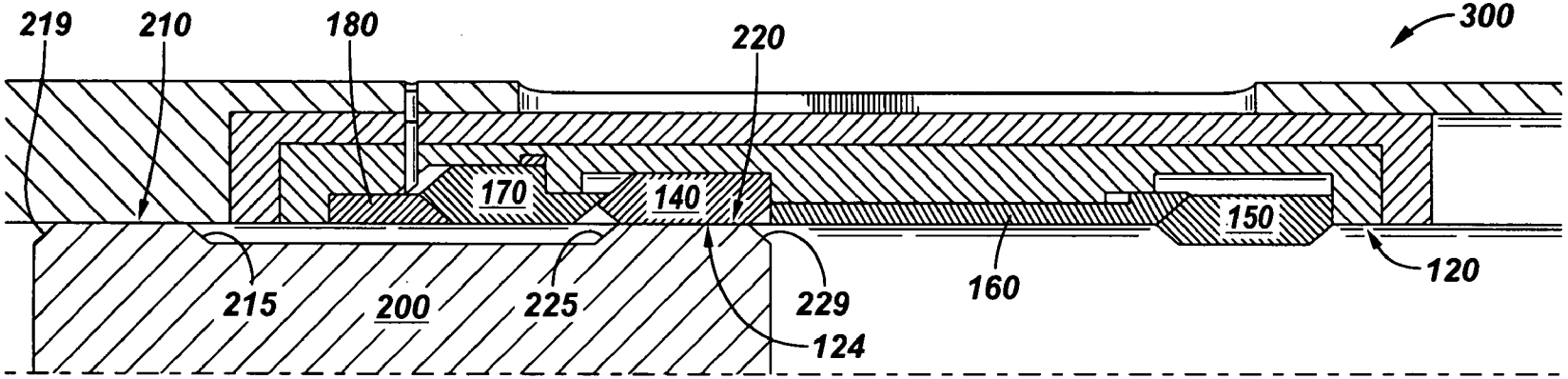

In FIG. 6 the first member 140 can be radially expanded, due to experiencing an external radially outward force due to the second contact point 220 contacting the first contact point 124. However, it is possible that the expansion of the first member 140 provides little or no movement to the fourth member 170. In one or more embodiments, the fourth member 170 can move due solely to the radial expansion of the first member 140 but will not fully radially compress the fifth member 180 or release the locking member 198.

Figure 7:
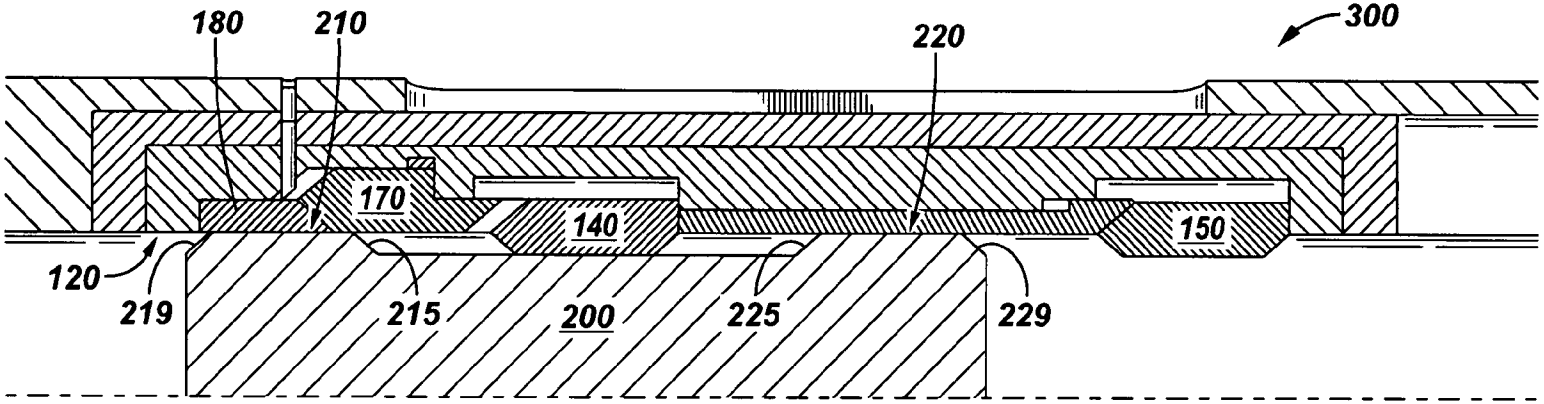

FIG. 7 depicts the second contact point 220 passing through the third member 160. When the surface of the actuator 200 between the second contact point 220 and the first contact point 210 passes through the first member 140, the first member 140 is unaffected. The first contact point 210 can pass through the fifth member 180 and the fourth member 170. When the first contact point 210 passes through the fifth member 180 and the fourth member 170, the first contact point 210 can leave the fifth member 180 and the fourth member 170 undisturbed.

Figure 8:
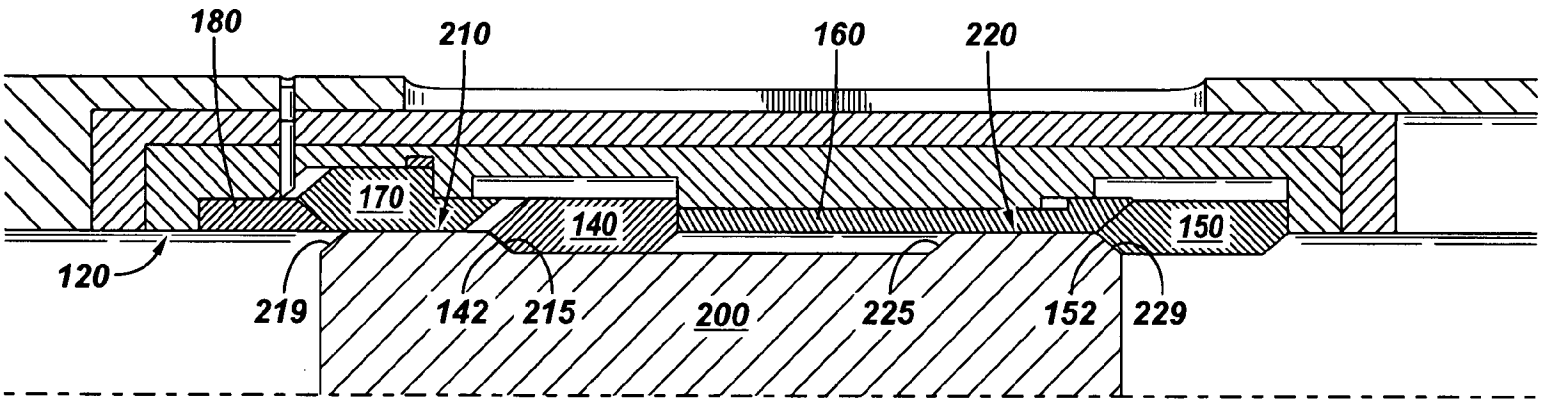
Figure 9:
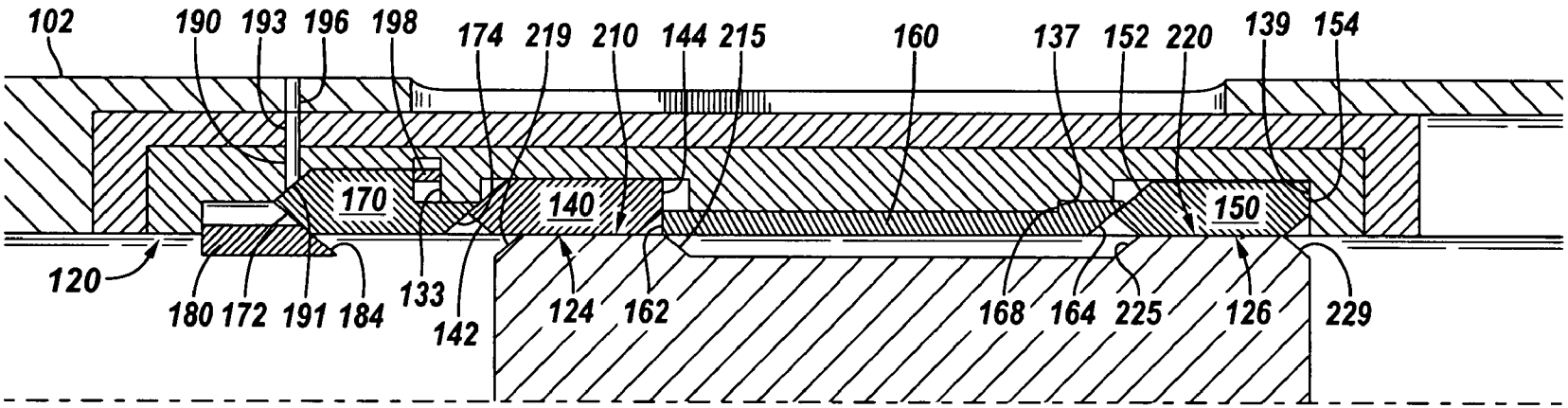

FIG. 8 depicts the second contact point 220 engaging the first end 152 of the second member 150, and the first contact point 210 engaging the first end 142 of the first member 140. In FIG. 9 the trigger mechanism 120 is shown actuated or activated, due to receiving the two positive inputs. For example, the two positive inputs can be the first contact point 210 and the second contact point 220 simultaneously engaging or radially expanding the second member 150 and the first member 140.

As the second member 150 radially expands, the second end 154 can travel along the second wall 139 of the third recess 138, and the first end 152 of the second member 150 can apply a force to the third member 160. For example, the first end 152 of the second member 150 can rest within or underneath the second end 164 of the third member 160. The first end 152 can have a sloped portion with a slope corresponding with a sloped portion of the second end 164 of the third member 160. The sloped portions of the first end 152 and the second end 164 can be such that the third member 160 longitudinally moves when the second member 150 is radially expanded. Accordingly, the force can be applied to the third member 160 as the sloped outer surface of the first end 152 travels along or is guided along the sloped inner surface of the second end 164. The vector of the force applied to the third member 160 by the first end 152 can be determined by the slope of the first end 152 and the slope of the second end 164. Furthermore, the force can be applied to different places on the second end 164 of the third member 160, depending on the slope of the first end 152 and the slope of the second end 164.

The third member 160 can have a longitudinal stroke or length of travel that can be limited by the interaction of the first wall 137 and the shoulder 168. For example, the stroke of the third member 160 can be limited such that the first end 162 moves the first member 140 longitudinally, when the second member 150 and first member 140 are radially expanded. In one or more embodiments, the stroke can be such that the first end 162 of the third member 160 slightly moves or urges the first member 140, even when only the second member 150 is radially expanded. However, the movement of the radially unexpanded first member 140 can be insufficient to provide longitudinal movement to the fourth member 170.

When the first member 140 is radially expanded, the first end 162 of the third member 160 can contact or travel along a sloped inner surface of the second end 164 and can longitudinally move the radially expanded first member 140. When the first member 140 is longitudinally moved, the radially expanded first member 140 can apply a force to the fourth member 170 and cause the fourth member 170 to move longitudinally. For example, a sloped outer portion of the first end 172 can travel along or apply force to a sloped inner surface of the second end 176. The movement of the fourth member 170 can be controlled by the shape of the first recess 132, the slope of the outer surface of the first end 172, and the slope of the inner surface of the second end 174.

The sloped inner surface of the first end 172 can apply an external radially inward or radially compressive force to the fifth member 180, as the inner surface of the first end 172 travels or is guided along the outer sloped surface of second end 184. Consequently, the fifth member 180 can be put in a radially compressed state or made to have a reduced diameter, due to the radially compressive force applied to the outer surface of the fifth member 180 by the fourth member 170, when the fourth member 170 is in the second position.

As the fourth member 170 moves longitudinally to the second position a gap can be formed between the second wall 133 of the first recess 132 and the fourth member 170. The locking member 198 can drop down or snap into the gap and can prevent the fourth member 170 from moving back to the first position.

When the fourth member 170 moves longitudinally, the first pin 191 can be moved radially by an outer sloped surface of the first end 172 contacting the sloped surface of the first end 191 of the first pin 190. The second end 193 of the first pin 190 can engage the second pin 196. When the second pin 196 is engaged by the second end 193, the second pin 196 can move radially out of or away from the sliding sleeve 110. The movement of the second pin 196 can free the sliding sleeve 110 from the valve housing 102.

Figure 10:
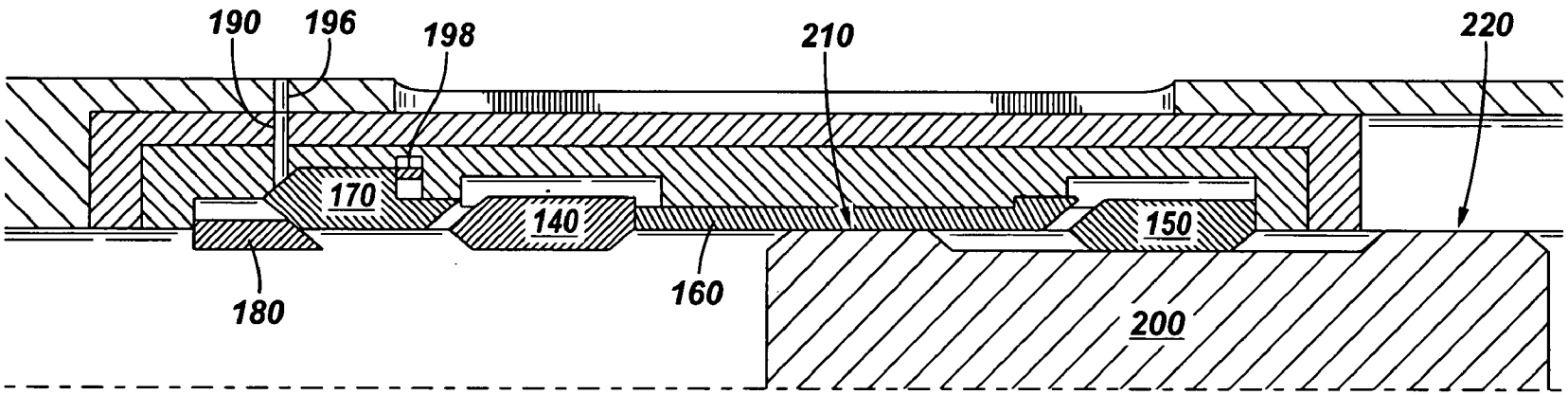

FIG. 10 depicts the actuator 200 further downhole. As the actuator 200 travels downhole, the first contact point 210 can disengage from the first member 140, and the second contact point 220 can disengage from the second member 150. In one or more embodiments, the actuator 200 can travel or flow downhole, and the actuator 200 can engage an activated trigger mechanism 120 disposed in a downstream downhole valve assembly or sliding sleeve (not shown). The fourth member 170 can be held in engagement with the fifth member 180 by the looking member 198. The fifth member 180, in a radially compressed state, can have a reduced inner diameter or inner flowpath. When the fifth member 180 is radially compressed, the trigger mechanism 120 can be said to be actuated.

Figure 11:
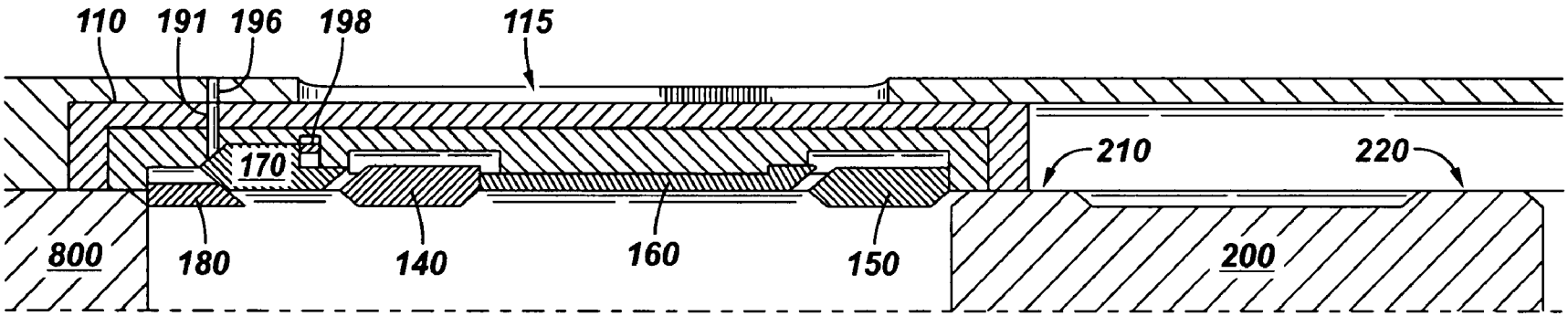

As depicted in FIG. 11, when the fifth member 180 has a radially compressed diameter, the fifth member 180 can catch an additional actuator 800 or dart flowing downhole subsequent to the second actuator 200. When pressure is applied or built-up behind the caught actuator 800, the caught actuator 800 can longitudinally move the sliding sleeve 110. After the sliding sleeve 110 is at least partially longitudinally moved from a first position to a second position, the inner bore of the valve housing 102 can communicate with the exterior of the valve housing 102, via port 115.

It is contemplated, that the flow of the actuator 200 through the second downhole valve assembly 500 can be reversed, i.e. the actuator 200 can enter the second downhole valve assembly 500 proximate the second member 150 instead of entering the second downhole valve assembly 500 proximate to the fifth member 180. In this arrangement, the trigger mechanism 120 can be actuated by the actuator 200, and the sliding sleeve 110 can be longitudinally moved by the actuator 200. In one or more embodiments, a plurality of downhole valve assemblies (not shown) similar to the first downhole valve assembly 200 and second downhole valve assembly 500 can be disposed downhole and can be actuated, as described above.

Figure 13:
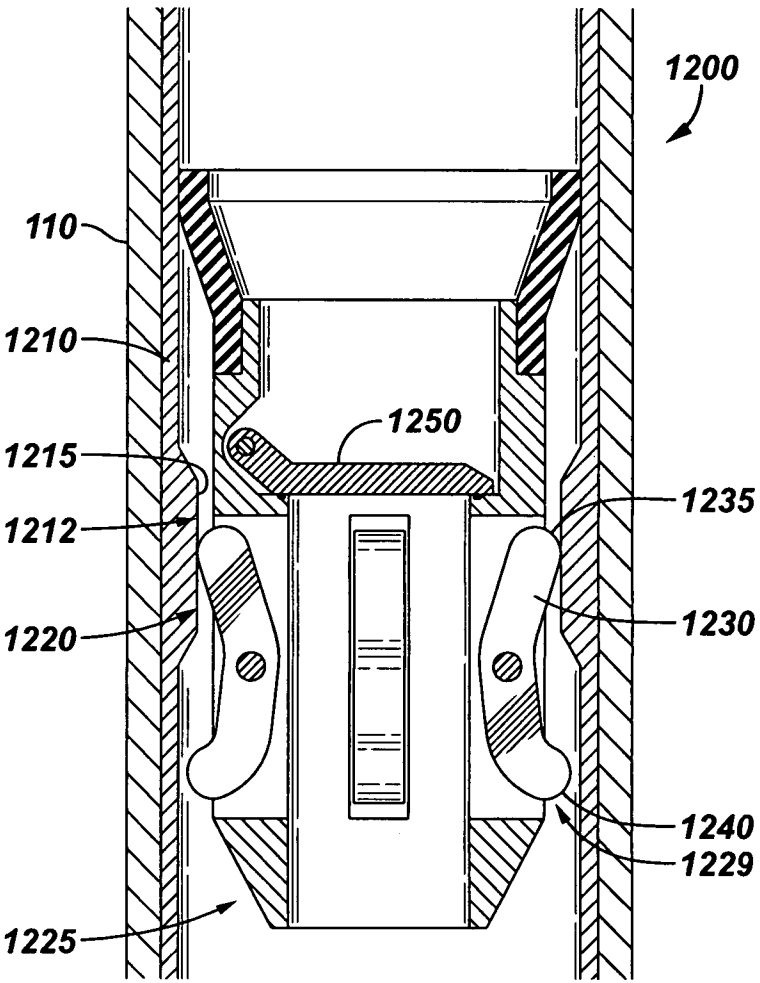
FIGS. 12-13 depict a cross-section view of an illustrative trigger mechanism disposed on a dart flowing through a first downhole valve assembly, according to one or more embodiments described.
Figure 12:
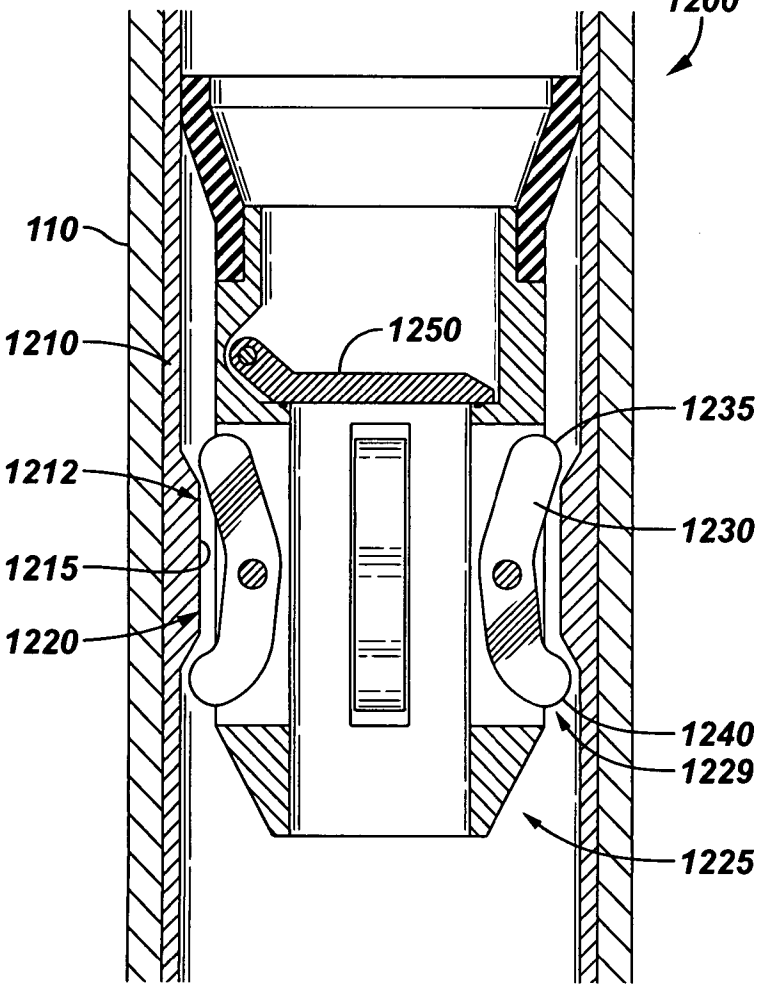

FIGS. 12-13 depict a cross-section view of an illustrative trigger mechanism 1229 disposed on a dart 1225 flowing through a first downhole valve assembly 1200, according to one or more embodiments. The downhole valve assembly 1200 can have one or more actuators 1210 having at least one raised portion or profile 1215 at least partially disposed within one or more sliding sleeves 110. The raised profile 1215 can have one or more contact points 1212, 1220. The actuator 1210 can be an inner surface or portion of the sliding sleeve 110, or the actuator 1210 can be an insert disposed within the sliding sleeve 110. The raised profile 1215 can have a longitudinal length, and the two contact points 1212, 1220 can be located anywhere thereon. The sliding sleeve 110 can be disposed in the valve housing, such as valve housing 102.

The dart 1225 can be any downhole instrument capable of flowing downhole. The trigger mechanism 1229 can include or be one or more rocker arms 1230 disposed on the dart 1225. The ends of the rocker arm 1230 can be the first and second contact points 1235, 1240 of the trigger mechanism 1229. The first contact point 1235 and second contact point 1240 can be spaced a longitudinal distance or a critical length from one another.

A flow path can be formed longitudinally through the center of the dart 1225. A check valve 1250 can be placed within the longitudinal flow path. The check valve 1250 can be a ball-seat check valve, a flapper check valve, or other check valve. The check valve 1250 can allow fluid flow in a first direction through the longitudinal flow path of the dart 1225, and the check valve 1250 can block fluid flow through the longitudinal flow path of the dart 1225 in a second direction. Therefore, the longitudinal flow path formed through the center of the dart 1225 can be unidirectional. The unidirectional flow path can allow for return of fluids from downhole and the blockage of fluids from uphole. Accordingly, when the trigger mechanism 1229 is actuated, pressure can be built-up behind the dart 1225.

The trigger mechanism 1229 can be actuated when the two contact points 1235, 1240 engage the two contact points 1212, 1220 simultaneously or near simultaneously. However, the trigger mechanism 1229 can pass through the downhole valve assembly 1200 without actuation if the contact points 1235, 1240 are spaced a longitudinal distance from one anther that is longer than the longitudinal length of the raised profile 1215.

FIG. 13 depicts a cross sectional view of the first downhole valve assembly 1200 with the trigger mechanism 1229 passing through the sliding sleeve 110. The trigger mechanism 1229 can pass through the valve assembly 1200 without actuation because the critical length between the contact points 1235, 1240 is longer than the longitudinal length of the raised profile 1215. Therefore, the two contact points 1235, 1240 of the trigger mechanism 1229 can pass through the first downhole valve assembly 1200 without simultaneously or near simultaneously contacting the contact points 1212, 1220 of the actuator 1210, and the trigger mechanism 1225 can remain in an original or deactivated state. Accordingly, the dart 1225 and the trigger mechanism 1229 can flow through the sliding sleeve 110 and can flow downhole to actuate or engage a second downhole valve assembly 1400, as depicted in FIGS. 14 and 15.

In one or more embodiments, the number of downhole valves that can be actuated using the methods described herein can be increased by varying both the longitudinal distance of the raised profile 1215 and the outer diameter of the dart. Accordingly, the dart with the reduced diameter will not engage with contact points 1212, 1220 of the raised profile 1215, and can engage with a reduced inner diameter raised profile further downhole (not shown). As such the actuation of the trigger mechanism 1229 by the actuator 1210 can be controlled by varying the length of the raised profile 1215, inner diameter of the raised profile 1215, or both and/or varying the longitudinal distance between the contact points 1212, 1220 the trigger mechanism 1229, the outer diameter of the trigger mechanism 1229, or both.

Figure 15:
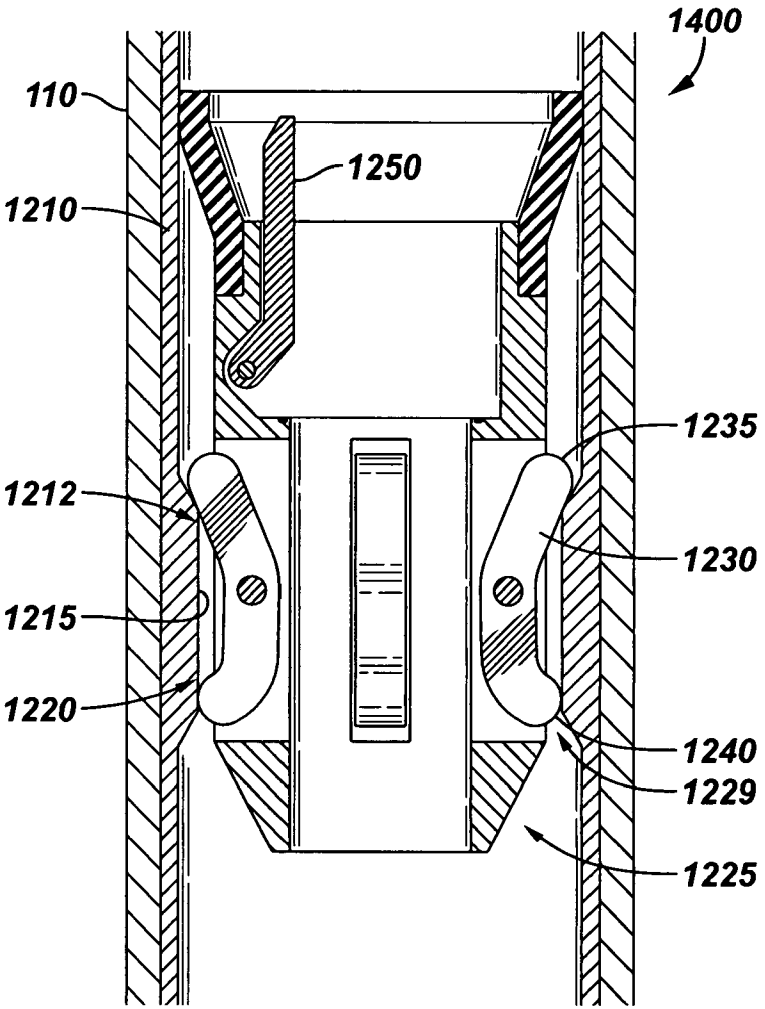
FIGS. 14-15 depict a cross-section view of the illustrative trigger mechanism of FIGS. 12-13 actuating while flowing through a second downhole valve assembly, according to one or more embodiments described.
Figure 14:
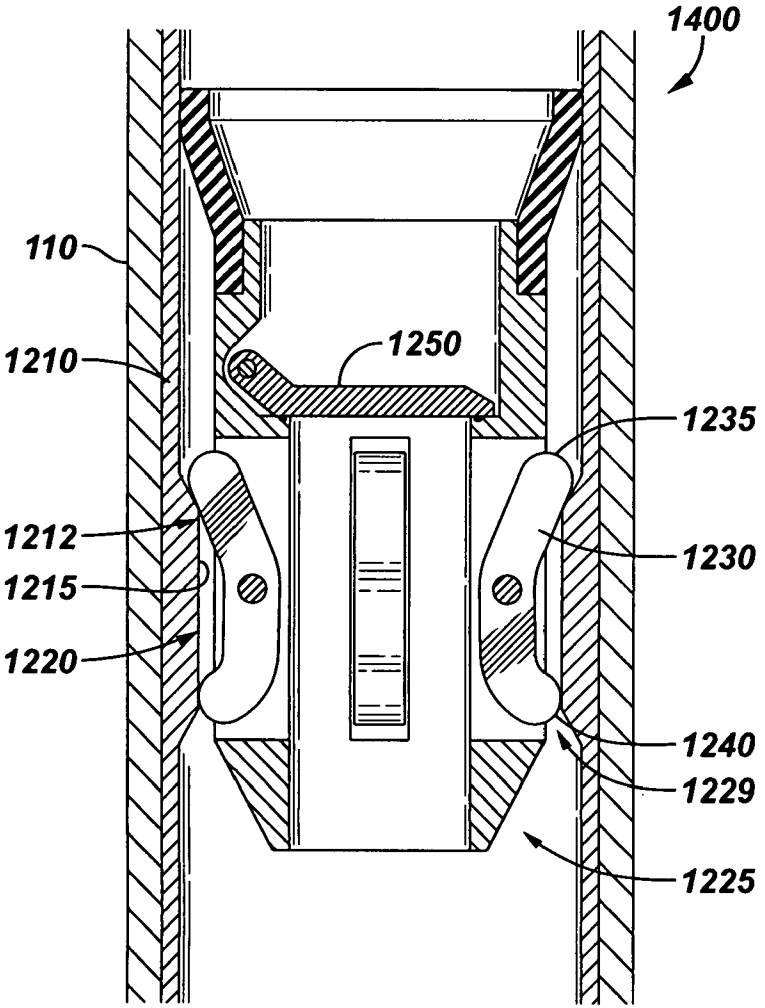

FIGS. 14-15 depict a cross-section view of the illustrative trigger mechanism 1225 actuating while flowing through a second downhole valve assembly 1400, according to one or more embodiments. The second downhole valve assembly 1400 can be substantially similar to the first downhole valve assembly 1200. The sliding sleeve 110 can be disposed about the actuator 1210 of the second downhole valve assembly 1400.

The longitudinal length of the raised profile 1215 of the second downhole valve assembly 1400 can be longer than or the same length of the critical length between the contact points 1235, 1240 of the trigger mechanism 1229. As such, the contact points 1235, 1240 can simultaneously contact the raised profile 1215 of second downhole valve assembly 1400, such as at contact points 1212, 1220. Accordingly, the trigger mechanism 1225 can engage the actuator 1210. The trigger mechanism 1225 can be said to be actuated when the trigger mechanism 1229 catches or otherwise secures to the actuator 1210. The actuated trigger mechanism 1229 can secure the dart 1225 to the actuator 1210, and pressure can be built up behind the dart 1225 to longitudinally move the sliding sleeve 110 from the first position to the second position. For example, pressure can be applied to the uphole portion of the dart 1225, until the dart 1225 moves the sliding sleeve 110. The movement of the sliding sleeve 110 can open the second downhole valve assembly 1400, as depicted in FIG. 15.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

The invention claimed is:

1. A downhole trigger mechanism comprising:

at least two contact points spaced a longitudinal distance from one another, wherein the trigger mechanism is actuated when the contact points of the trigger mechanism are simultaneously contacted by at least two contact points of an actuator, and wherein the contact points of the actuator are spaced a longitudinal distance from one another;

a housing having at least a first recess, a second recess, and a third recess;

a first member at least partially disposed within the second recess, wherein at least a portion of an inner surface of the first member is one of the contact points of the trigger mechanism; wherein the first member comprises a first end and a second end;

a second member disposed at least partially within the third recess, wherein at least a portion of the inner surface of the second member is one of the contact points of the trigger mechanism, wherein the second member comprises a first end and second end;

a third member at least partially disposed between the second end of the first member and the first end of the second member, wherein the second member comprises a first end and a second end;

a fourth member at least partially disposed within the first recess, wherein the fourth member comprises a first end and a second end, wherein the second end of the fourth member is adjacent the first end of the first member; and a fifth member at least partially disposed within the first recess, wherein the fifth member has an inner diameter that is adjustable, wherein the fifth member comprises a first end and a second end; and wherein the second end of the fifth member is aligned with the first end of the fourth member.

2. The trigger mechanism of claim 1, wherein at least a portion of the second end of the second member is parallel to a second wall of the third recess, wherein the outer surface of the first end of the second member is sloped, and wherein the first end of the second member is at least partially overlapped by a complimentary sloped inner surface of the second end of the third member.

3. The triggering mechanism of claim 1, wherein the second end of the first member is adjacent the first end of the third member.

4. The triggering mechanism of claim 1, wherein the third member is at least partially disposed in the third recess, and wherein an longitudinal stroke of the third member is limited by the first wall of the third recess.

5. The downhole valve assembly of claim 1, wherein the first end of the first member has a sloped outer surface complimentary to a sloped inner surface of the second end of the fourth member, and wherein the first member and fourth member are spaced a longitudinal distance from one another.

6. The downhole valve assembly of claim 1, further comprising a locking member disposed between the housing of the trigger mechanism and the fourth member.

7. The downhole valve assembly of claim 1, wherein a first pin is at least partially disposed through the housing of the trigger mechanism, wherein the first pin has a first end and a second end, and wherein the first end of the first pin has a sloped surface that is complimentary to a sloped outer surface of the first end of the fourth member.

8. A method for actuating downhole valve assembly comprising:

engaging a trigger mechanism comprising at least two contact points spaced a longitudinal distance from one another with an actuator comprising at least two contact points spaced a longitudinal distance from one another, wherein the engagement occurs at least partially within a sliding sleeve; and actuating the trigger mechanism by simultaneously contacting the two contact points of the trigger mechanism with the two contact points of the actuator.

9. The method of claim 8, wherein the actuator comprises a dart or an internal profile of the sliding sleeve.

10. The method of claim 8, wherein the trigger mechanism is secured to at least an inner portion of the sliding sleeve.

11. The method of claim 8, wherein the trigger mechanism is disposed on a dart.

12. The method of claim 8, wherein actuating the trigger mechanism comprises the trigger mechanism attaching with the actuator, and wherein pressure is applied to the attached actuator and trigger mechanism to longitudinally move the sliding sleeve.

13. The method of claim 8, wherein trigger mechanism comprises:

a housing having at least a first recess, a second recess, and a third recess;

a first member at least partially disposed within the second recess, wherein at least a portion of an inner surface of the first member is one of the contact points of the trigger mechanism; wherein the first member comprises a first end and a second end;

a second member disposed at least partially within the third recess, wherein at least a portion of the inner surface of the second member is one of the contact points of the trigger mechanism, wherein the second member comprises a first end and second end;

a third member at least partially disposed between the second end of the first member and the first end of the second member, wherein the second member comprises a first end and a second end;

a fourth member at least partially disposed within the first recess, wherein the fourth member comprises a first end and a second end, wherein the second end of the fourth member is adjacent the first end of the first member; and a fifth member at least partially disposed within the first recess, wherein the fifth member has an inner diameter that is adjustable, wherein the fifth member comprises a first end and a second end; and wherein the second end of the fifth member is aligned with the first end of the fourth member.

14. The method of claim 13, wherein actuating the trigger mechanism comprises radially compressing the fifth member.

15. The method of claim 14, wherein the radially compressed member catches the actuator.

16. The method of claim 14, further comprising sending an additional downhole instrument downhole and catching the additional instrument with the radially compressed fifth member.

17. The method of claim 8, wherein the trigger mechanism comprises at least one rocker arm pivotally attached to a dart, wherein the rocker arm comprises two arms spaced apart a longitudinal distance from one another, and wherein the ends of the arms are the contact points of the trigger mechanism.

18. The method of claim 17, wherein the actuator is a raised portion of the inner diameter of the sliding sleeve, and wherein actuating the trigger mechanism comprises simultaneously contacting the raised portion with the ends of the arm.

19. A method for opening a downhole valve, comprising:

engaging a trigger mechanism comprising two contact points spaced a longitudinal distance from one another with an actuator comprising two contact points spaced a longitudinal distance from one another; and wherein one of the actuator or the trigger mechanism is secured to the inner diameter of a sliding sleeve, and wherein the sliding sleeve is configured to selectively open a downhole valve;

contacting the two contact points of the trigger mechanism with the two contact points of the actuator;

attaching the actuator with the trigger mechanism; and applying pressure to the attached actuator and trigger mechanism, thereby longitudinally moving the sliding sleeve.

* * * * *